US007174603B2

(12) United States Patent
Sclafani et al.

(10) Patent No.: US 7,174,603 B2
(45) **Date of Patent: *Feb. 13, 2007**

(54) MULTI-PURPOSE POSITION SENSITIVE FLOOR CLEANING DEVICE

(75) Inventors: Adam C. Sclafani, North Canton, OH (US); William G. Alford, North Canton, OH (US); Kevin L. Thomas, North Canton, OH (US)

(73) Assignee: The Hoover Company, North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/018,037

(22) Filed: Dec. 21, 2004

(65) Prior Publication Data

US 2005/0132525 A1 Jun. 23, 2005

Related U.S. Application Data

(60) Continuation of application No. 10/452,968, filed on Jun. 2, 2003, now Pat. No. 6,851,158, which is a division of application No. 09/727,722, filed on Dec. 1, 2000, now Pat. No. 6,572,711.

(51) Int. Cl.
*A47L 11/30* (2006.01)

(52) U.S. Cl. ..... 15/320

(58) Field of Classification Search ..... 15/319, 15/320, 328, 339, 416, 417
See application file for complete search history.

(56) References Cited

U.S. PATENT DOCUMENTS

| | | | | |
|---|---|---|---|---|
| 2,089,911 | A * | 8/1937 | Replogle | 15/320 |
| 2,857,615 | A * | 10/1958 | Anderson | 15/373 |
| 2,867,835 | A * | 1/1959 | Brown, Jr. et al. | 15/328 |
| 3,029,461 | A * | 4/1962 | Osborn | 15/320 |
| 3,079,623 | A * | 3/1963 | Congdon | 15/328 |
| 5,617,610 | A * | 4/1997 | Dearaujo | 15/328 |
| 5,983,448 | A * | 11/1999 | Wright et al. | 15/365 |
| 6,572,711 | B2 * | 6/2003 | Sclafani et al. | 134/21 |
| 6,851,158 | B2 * | 2/2005 | Sclafani et al. | 15/319 |

* cited by examiner

*Primary Examiner*—Terrence R. Till
(74) *Attorney, Agent, or Firm*—A. Burgess Lowe, Esq.; Brett A. Schenck, Esq.

(57) ABSTRACT

This invention relates to a multi-purpose position sensitive floor cleaning device having two separate and distinct selective modes of operation whereby 180° longitudinal rotation of the floor cleaning device selectively activates one of the two separate and distinct selective modes of operation. The two separate and distinct selective modes of operation are, for example, a scrubbing mode for scrubbing an associated floor and a suctioning mode for suctioning associated liquid from the associated floor.

14 Claims, 7 Drawing Sheets

MULTI-PURPOSE POSITION SENSITIVE FLOOR CLEANING DEVICE

CROSS REFERENCE TO RELATED APPLICATIONS

This application is a Continuation Application of application Ser. No. 10/452,968 filed on Jun. 2, 2003 now U.S. Pat. No. 6,851,158, which is a Divisional Application of application Ser. No. 09/727,722 filed on Dec. 1, 2000 now U.S. Pat. No. 6,572,711.

BACKGROUND OF THE INVENTION

1. Field of Invention

This invention pertains to a floor-cleaning device. More specifically, this invention pertains to a multi-purpose position sensitive floor-cleaning device having a gravity switch that selectively activates at least a first motor to provide power to at least a first implement when the cleaner is rotated or flipped about its longitudinal axis.

2. Description of the Related Art

It is known in the prior art to provide floor-cleaning devices operated by a switch containing two tubes of mercury, also known as gravity switches. For example, gravity switches have been used to create a "dead man" condition in floor cleaning devices. U.S. Pat. No. 2,138,279 ('279 patent) (expired) discloses such a "dead man" switch. The '279 patent relates to a control switch that includes two tubes of mercury, which are mounted in a head of a floor care appliance. Each tube includes two spaced contacts, which are interposed in an electric circuit. Rotating handgrips that tilt the mercury tubes to complete the circuit operates the machine. A spring is provided to create the "dead man" condition. When the handgrips are released, the spring returns the mercury tubes to the "off" position. Thus, a gravity switch on a floor care appliance for use as a "dead man" switch is known in the art. However, the '279 patent does not disclose the use of a gravity switch to alternate between two or more modes of operation such as scrubbing and suction modes.

It is also known to use a level-sensitive switch to turn off a motor on a carpet-cleaning machine when the handle of the device is tilted. In U.S. Pat. No. 4,146,944 ('944 patent) (expired), a carpet cleaning machine having a handle, a cleaning head with a brush, a brush motor, a solution supply tank, a rinsing reservoir, a waste tank, a vacuum head and a vacuum pump is disclosed. A level sensitive switch is provided in the cleaning head to turn off the brush motor when the handle is tilted to raise the brush and lower the vacuum head. Further, the '944 patent discloses that the same level sensitive switch can be used to turn the vacuum motor on when the handle is tilted. Thus, the level sensitive switch disclosed in this patent selectively activates a first motor, namely, the brush motor, when the handle is tilted to lower the brush and raise the vacuum head. In addition, the gravity switch selectively activates a second motor, namely, the vacuum motor, when the handle is tilted to raise the brush and lower the vacuum head. However, the patent does not disclose rotation of the entire unit to selectively activate a mode of operation.

Another example of use of the use of gravity to influence a device is found in U.S. Pat. No. 3,676,890 ('890 patent) (expired). The '890 patent relates to a suction cleaner having a detent mechanism pivotally mounted by a pin on the handle control lever. The detent includes an arcuate surface at one end; a portion on the other side of the pivot pin is weighted so that it is influenced by gravity to rotate the detent when the cleaner is up-ended onto a surface. The detent engages a roller to lock the cleaner in the upright position and prevent actuation of a switch actuator.

The present invention is an improved multi-purpose position sensitive floor cleaning device having two separate and distinct selective modes of operation whereby 180° rotation of the multi-purpose position sensitive floor cleaning device selectively activates at least one of the two separate and distinct selective modes of operation.

SUMMARY OF THE INVENTION

It is an object of the present invention to provide a multi-purpose position sensitive floor-cleaning device having two separate and distinct selective modes of operation whereby 180° rotation of the floor-cleaning device selectively activates one of the two separate and distinct selective modes of operation. The two separate and distinct selective modes of operation are, for example, a scrubbing mode for scrubbing an associated floor and a suctioning mode for suctioning associated liquid from the associated floor.

The activation of the one of the two separate and distinct selective modes of operation can be accomplished, in its preferred embodiment, by a gravity switch. The gravity switch activates one of the two separate and distinct selective modes of operation due to the gravitational force acting upon the gravity switch.

Another object of the present invention is the multi-purpose position sensitive floor cleaning device to have a longitudinal axis with a cleaning head at a first end of the longitudinal axis and a handle at a second end of the longitudinal axis, a motor being located between the first and second ends for operating the cleaning head, wherein the improvement comprises a switch for activating and deactivating the motor, the switch activates the motor when the floor care device is rotated about the longitudinal axis and when the cleaning head is placed in contact with the floor surface, and the switch deactivating the motor when the floor care device is rotated about the longitudinal axis to place the cleaning head in a non-contact position with the floor surface.

Another object of the improved multi-purpose position sensitive floor cleaning device is to rotate the floor care device 180°, thus placing the cleaning head in a non-contact position with the floor surface.

Another object of the present invention disclosed herein is an improved multi-purpose position sensitive floor-cleaning device for cleaning a bare floor. The improved floor cleaning device has a longitudinal axis, a handle, a housing, the housing having first and second ends, the first end of the housing being attached to the handle, at least two separate and distinct modes of operation, the at least two separate and distinct modes of operation, for example, being a cleaning mode and a suction mode, at least one implement operatively attached to the second end of the housing and having an axis parallel to a plane of a floor, the axis being perpendicular to the longitudinal axis of the improved floor cleaning device, the at least one implement operatively attached to the second end of the housing comprises two implements, the two implements being a power-driven brush and a pump communicating with a nozzle for dispensing a cleaner, the power-driven brush and the pump being located substantially opposite one another, at least one motor operatively connected to the at least one implement, a means for supplying power to the improved floor cleaning device, a means for activating and deactivating the means for supplying power, a means for activating and deactivating the at least one motor, the means for activating and deactivating the means for supplying power being a first switch, the means for activating and deactivating the at least one motor activating the motor by rotating the improved cleaning device 180° about its longitudinal axis such that the at least one implement is in contact with a surface of a floor, the means for activating and deactivating the at least one motor selectively deactivating the at least one motor when the cleaning device is rotated about the longitudinal axis such that the at least one implement is not in contact with the surface of the floor, the means for activating and deactivating the at least one motor being a gravity switch connected to the second motor and, wherein the floor cleaning device is a bare floor cleaning device.

These and other objects of the present invention are achieved by the present invention wherein there is provided a floor cleaning device comprised of a motor housing having first and second ends, a handle attached to the first end of the motor housing, a cleaning housing having first and second ends, wherein the first end of the cleaning housing is attached to the second end of the motor housing, a nozzle attached to the second end of the cleaning housing, a cleaning solution delivery system positioned within the cleaning housing for dispensing unused cleaning solution onto a floor surface and a recovery tank positioned within the cleaning housing for holding dirty cleaning solution. The device further comprises a means for selectively providing power to the suction motor. The means for supplying power is positioned within the motor housing and includes a master switch, a pump, a suction motor for providing power to the pump, a power means for providing an electrical current to the suction motor and a gravity switch operatively connected to the power means and the suction motor. The device further comprises a power driven brush system for selectively providing power to the brush motor. The power driven brush system includes a power driven brush operatively attached to the nozzle and a power driven motor operatively connected to the gravity switch. When the cleaning device is rotated about its longitudinal axis such that the nozzle faces the floor surface, the gravity switch turns off the brush motor and simultaneously turns on the suction motor. In addition, when the cleaning device is rotated about its longitudinal axis such that the power driven brush faces the floor surface, the gravity switch turns off the suction motor and simultaneously turns on the brush motor.

Another object of the present invention is to provide a method of cleaning a floor surface with a floor cleaning device having at least two modes of operation, at, least one means for supplying power, at least one means for activating/deactivating the floor cleaning device, the modes of operation being located opposite one another on the floor cleaning device, wherein the method is the steps of placing the floor cleaning device in a first position contacting the floor, rotating the entire cleaning device a first time, the first rotation of the device is preferably a 180° rotation, to activate the means for supplying power to the floor cleaning device, and rotating the cleaning device a second time to deactivate the means for supplying power to the floor cleaning device. An additional step includes the method wherein the floor cleaning device further has first and second implements mounted opposite one another on the floor cleaning device and selectively contact the floor, and wherein the step of rotating the device a first time results in either the first or the second implement contacting the surface of the floor.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, preferred embodiments of which will be described in detail in this specification and illustrated in the accompanying drawings, which form a part hereof and herein.

DETAILED DESCRIPTION OF THE INVENTION

Figure 1:
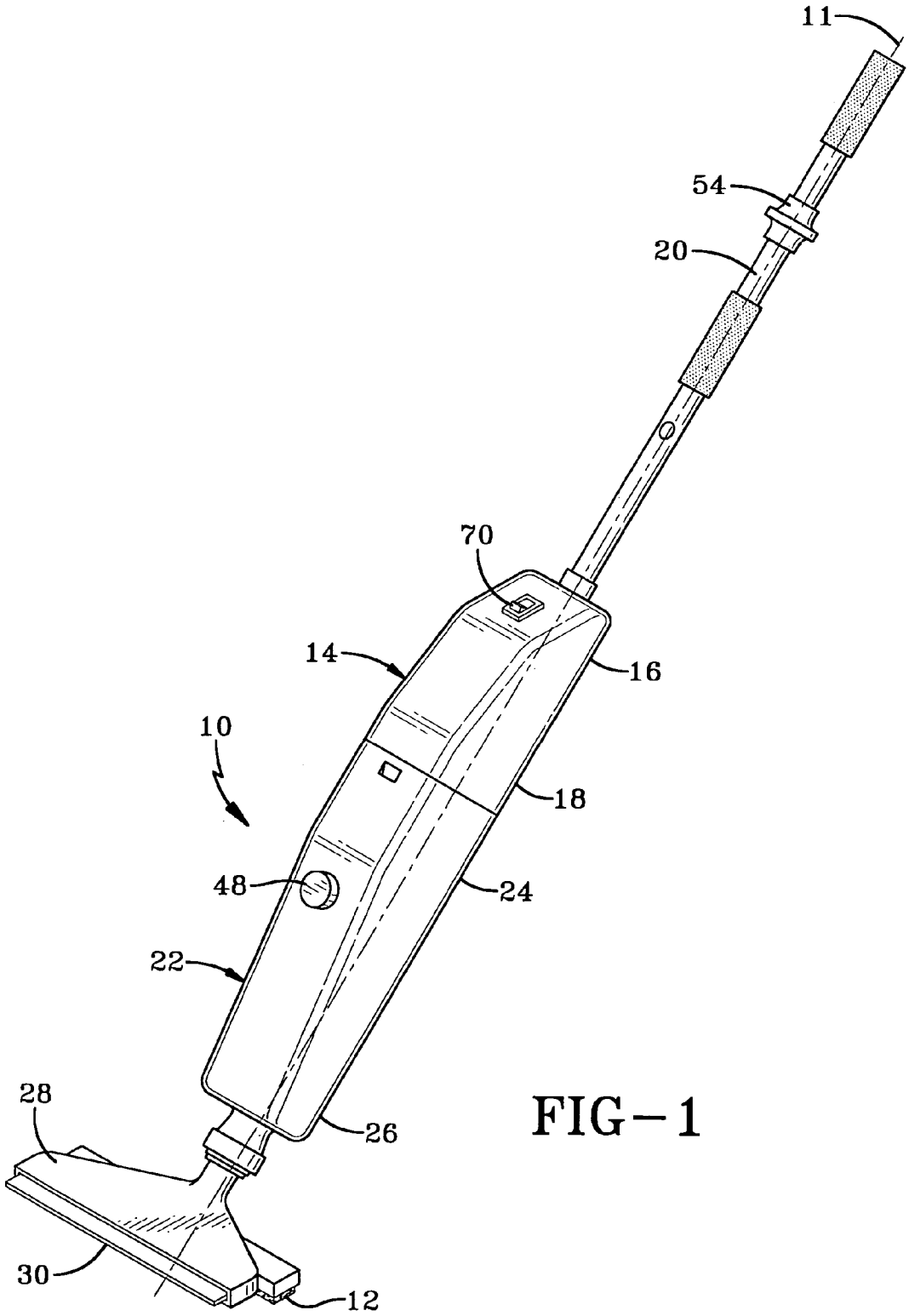
FIG. 1 is a perspective view of the cleaning device having a stationary brush.
Figure 2:
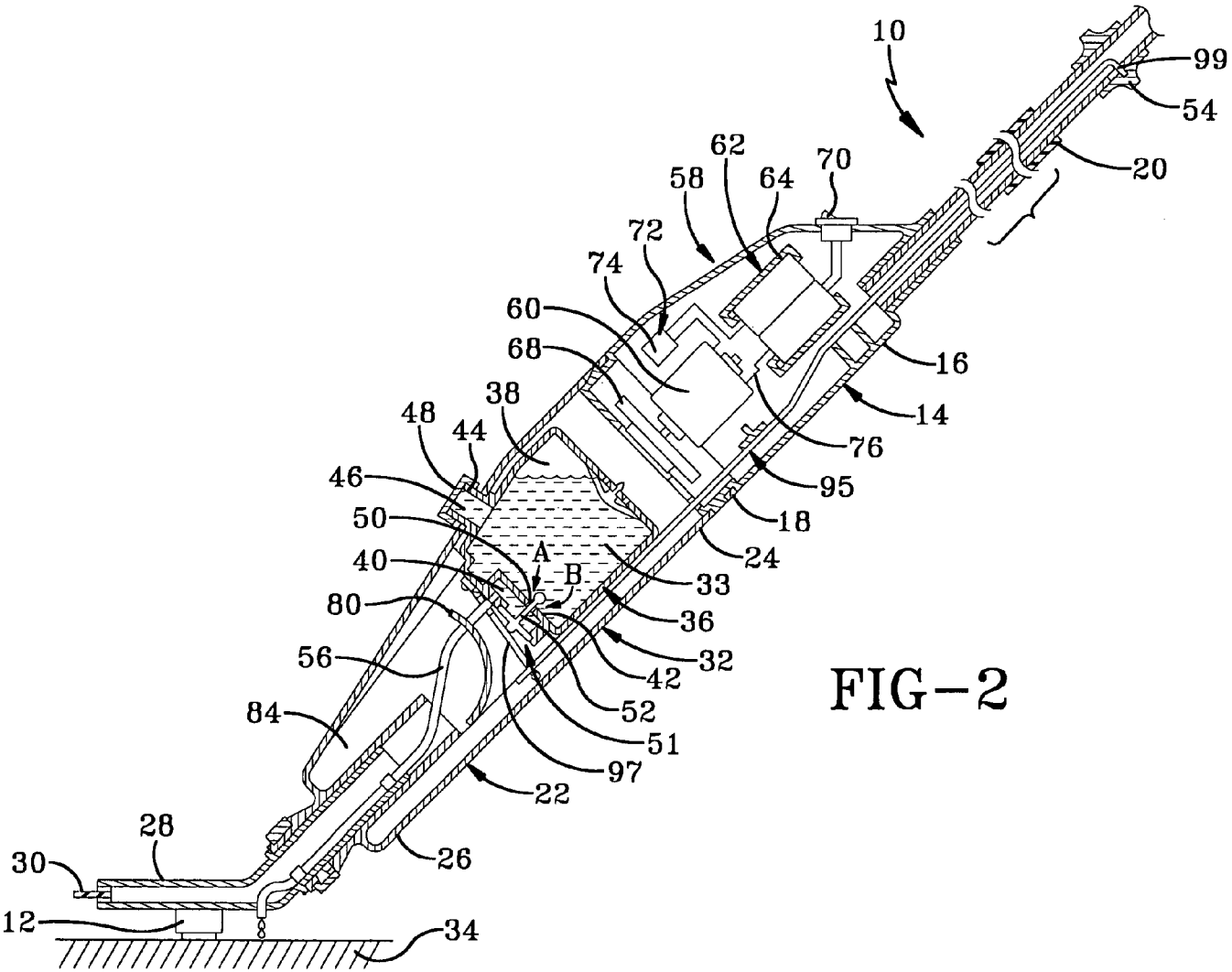
FIG. 2 is a side sectional view of the cleaning device having a stationary brush showing the device in the scrubbing mode.
Figure 3:
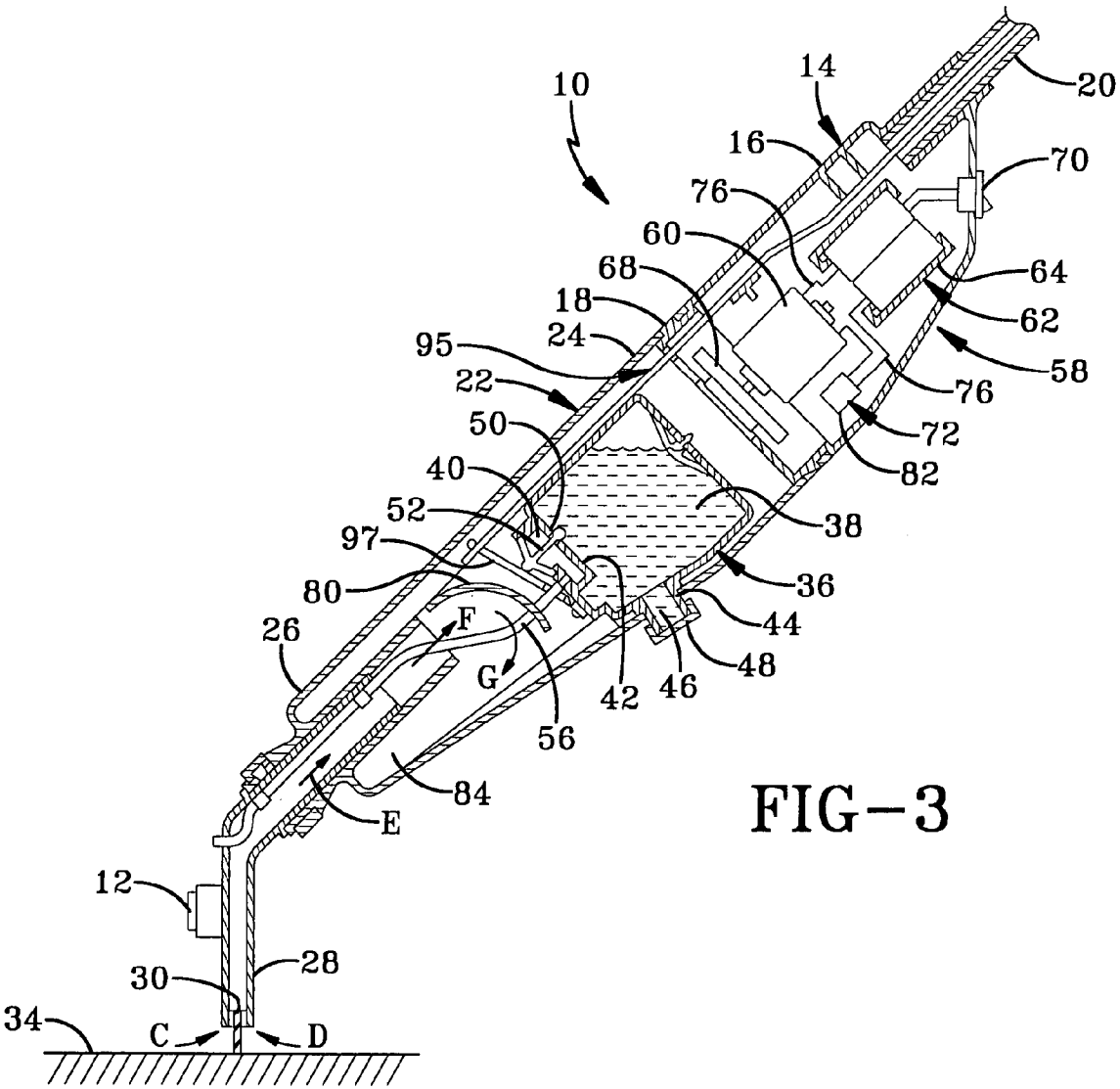
FIG. 3 is a side sectional view of the cleaning device having a stationary brush showing the device in the suction mode.
Figure 4:
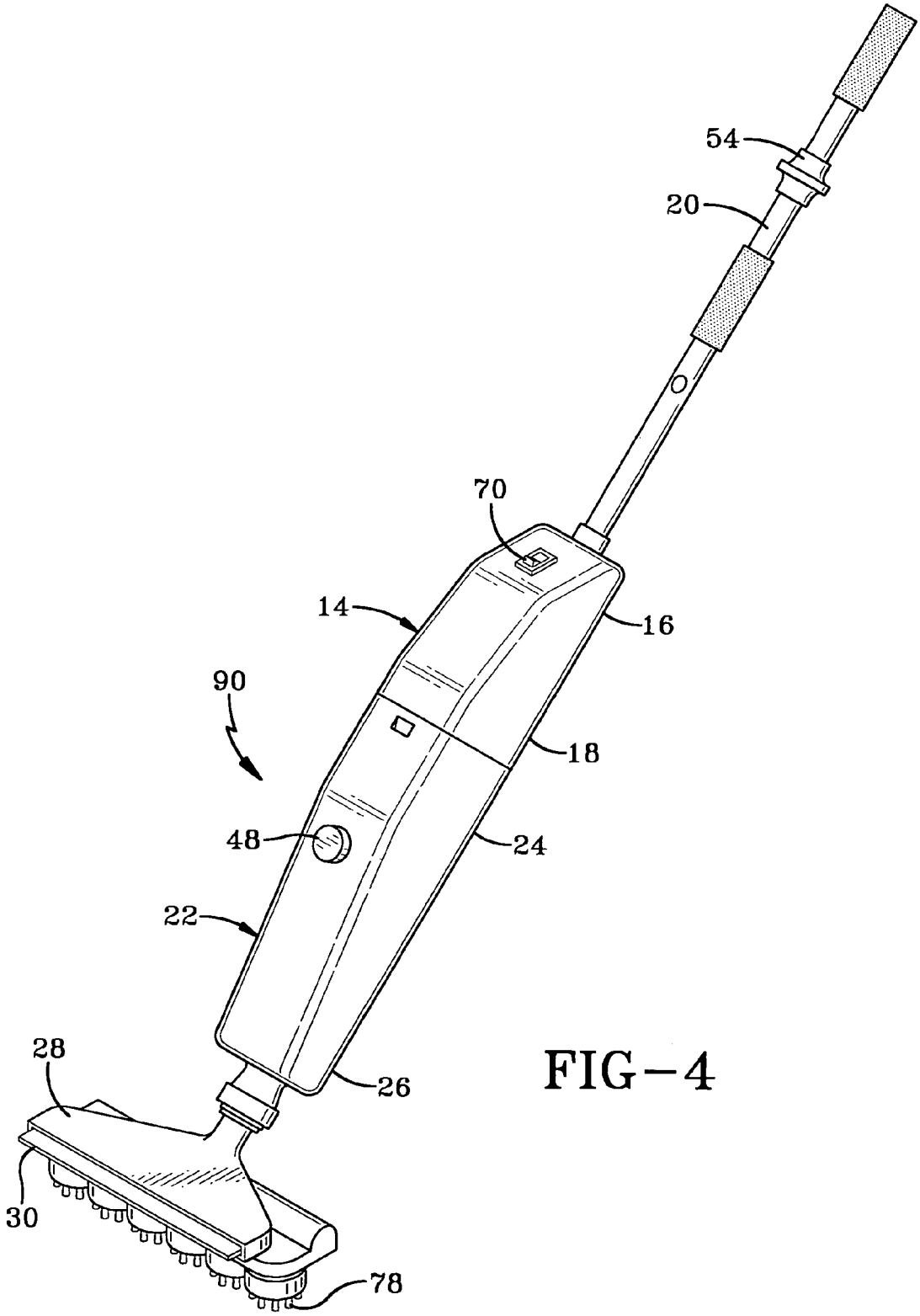
FIG. 4 is a perspective view of the cleaning device having a power driven brush.
Figure 5:
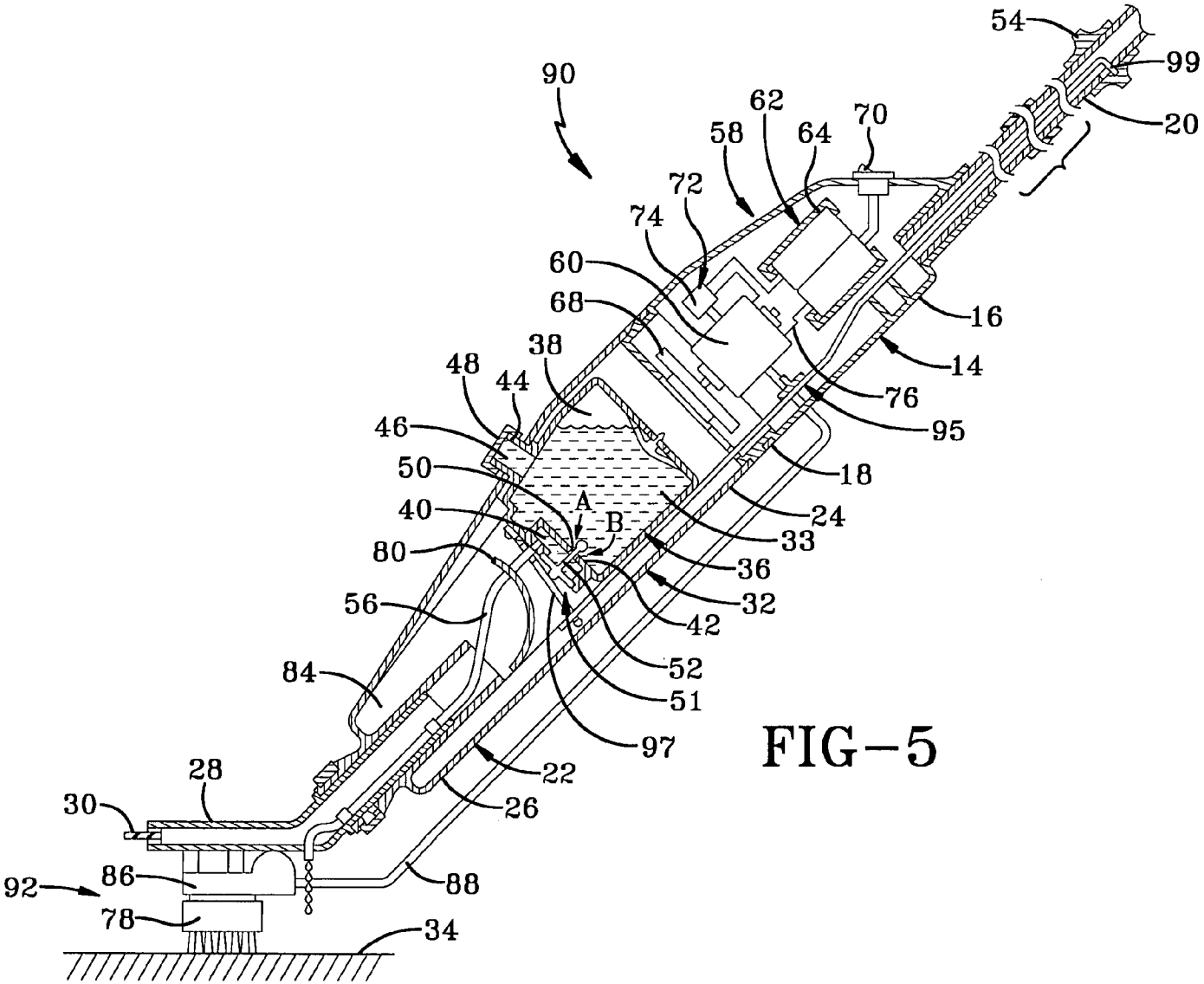
FIG. 5 is a side sectional view of the cleaning device having a power driven brush showing the device in the scrubbing mode.
Figure 6:
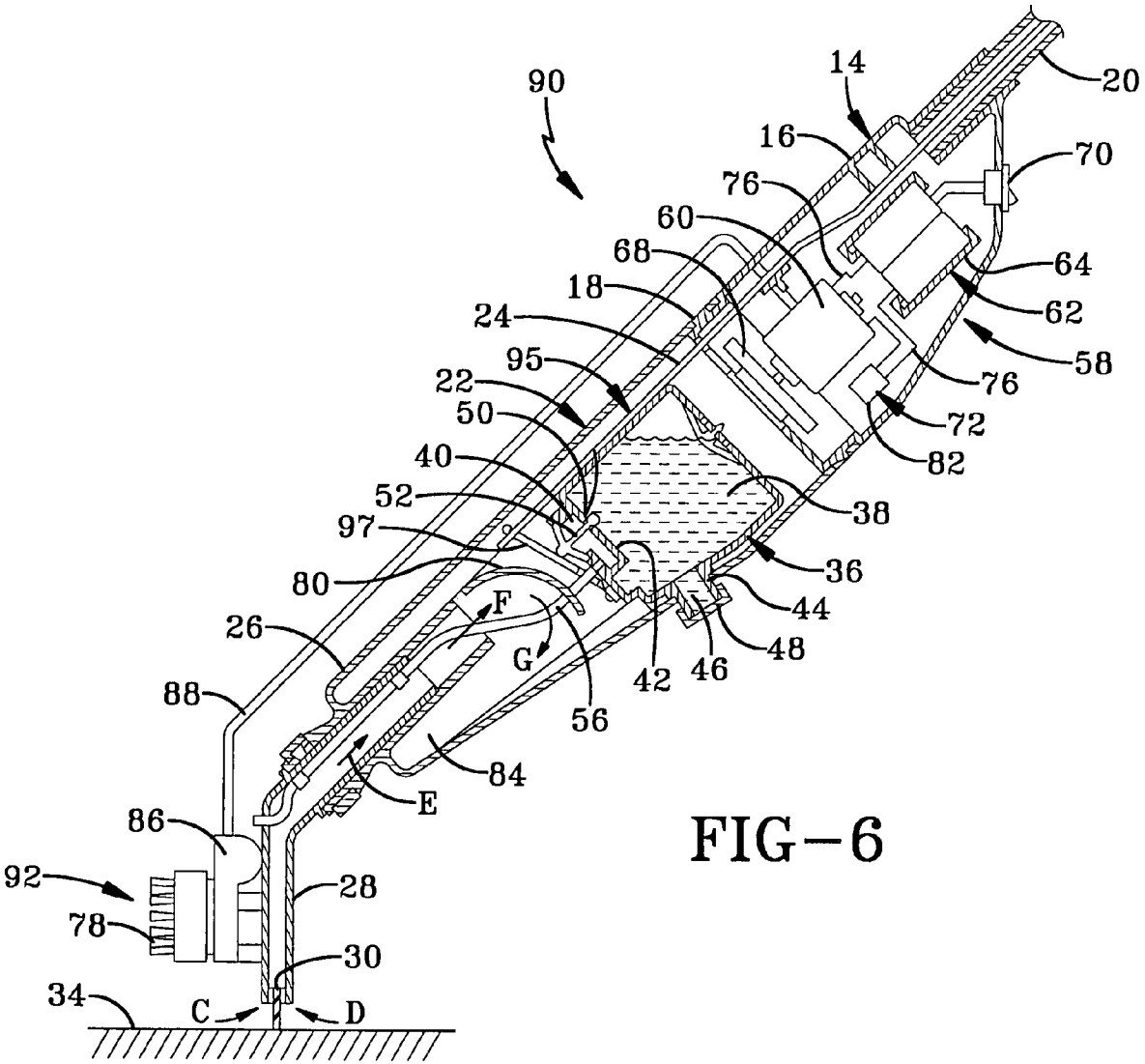
FIG. 6 is a side sectional view of the cleaning device having a power driven brush showing the device in the suction mode; and, FIG. 7 is a perspective view of the cleaning device having a stationary brush showing an AC power source.

Referring now to the drawings wherein the showings are for purposes of illustrating preferred embodiment(s) of the invention only and not for purposes of limiting the same, FIGS. 1–3 show a preferred embodiment of the invention. FIGS. 4–6 show a second preferred embodiment of the invention.

With reference to FIG. 1, a cleaning device 10 has a first implement 12, a removable motor housing 14 having first and second ends 16, 18, a handle 20 that is connected to the first end of the motor housing 16 and that extends upwardly therefrom, a cleaning housing 22 having first and second ends 24, 26, a second implement 28 having a preferred embodiment squeegee 30 connected to the second end 26 of the cleaning housing 22, and wherein the first implement 12 is mounted approximately opposite the nozzle 28. In the preferred embodiment, the first. implement 12 is shown as a stationary brush (also referenced as 12) and the second implement 28 is a nozzle (also referenced as 28). The second end 18 of the motor housing 14 is removably attached to the first end 24 of the cleaning housing 22 to facilitate the emptying and cleaning of a recovery tank 84, which is located within the cleaning housing 22, as will be explained in further detail below. In the preferred embodiment, the removable motor housing 14 has a substantially u-shaped configuration and can be assembled/disassembled to the cleaning device 10 by known means in the art.

With continuing reference to FIG. 1, in the preferred embodiment, the squeegee 30 facilitates the nozzle 28 in the removal of dirty cleaning solution from the floor surface 34. However, the nozzle 28 will adequately remove the dirty cleaning solution from the floor surface 34 without the assistance of the squeegee 30.

With reference to FIG. 2, the first end 24 of the cleaning housing 22 contains a cleaning solution delivery system 32. The delivery system 32 dispenses a cleaning solution 33 onto the floor surface 34 for later scrubbing by a means for scrubbing the associated floor, identified in the preferred embodiment as the stationary brush 12. The cleaning solution 33 used in the present invention may be any known cleaning solution or combination of solutions, such as water with a detergent additive.

With continuing reference to FIG. 2, the cleaning solution delivery system 32 includes a cleaning solution delivery tank 36 having first and second chambers 38, 40, a means 51 for releasing the unused cleaning solution 33 and a cleaning solution delivery tube 56. The first chamber 38 of the delivery tank 36 sits atop the second chamber 40 and a separator wall 42 separates the two chambers 38, 40. The first chamber 38 holds the unused cleaning solution 33 and selectively releases it into the second chamber 40, which in turn releases the solution onto the floor surface 34 via the solution delivery tube 56, as will be explained in further detail below. The first chamber 38 has an aperture 44 for receiving the unused cleaning solution 33. The aperture 44 in the first chamber 38 is aligned with an aperture 46 in the cleaning housing 22 and opens thereto to facilitate filling of the first chamber 38 with the unused cleaning solution. The aperture 46 on the cleaning housing 22 is provided with a threaded dispensing cap 48 that can be removed to allow a user to fill the first chamber 38 with solution.

With continuing reference to FIG. 2, the means 51 for selective release of unused cleaning solution 33 from the first chamber 38 to the second chamber 40 is accomplished, in the preferred embodiment, by a plunger 52. The plunger 52 is received within an aperture 50 located on the separator wall 42. The plunger 52 also abuts the bottom portion 97 of a control rod 95 which is connected at its upper portion 99 to a means for releasing the liquid 54 (shown in FIG. 1) positioned on the handle 20 of the cleaning device 10 which controls the dispensing of the unused cleaning solution 33. The means for releasing liquid 54 selectively moves the control rod 95 to move the plunger 52 from a closed position to an open position and vice versa. FIG. 2 shows the plunger 52 in its open position. FIG. 3 shows the plunger 52 in its closed position. With reference to FIG. 3, the plunger 52 seals the aperture on the separator wall 42 and prevents the unused cleaning solution 33 from being released into the second chamber 40. However, engagement of the means for releasing liquid 54 selectively moves the plunger 52 in an upwards direction to its second position, as shown in FIG. 2. With reference to FIG. 2, when the plunger 52 is in its open position, the seal surrounding the aperture 50 on the separator wall 42 is broken which causes a gravitational flow of cleaning solution 33, as shown by arrows A and B, from the first chamber 38 to the second chamber 40. This, in turn, causes a gravitational flow of the solution 33 from the second chamber 40 through the solution delivery tube 56, which is attached to the bottom of the second chamber 40 and extends downward through the nozzle 28, and onto the floor surface 34. The gravitational flow of cleaning solution onto the floor surface 34 is stopped by disengaging the means for releasing liquid 54 which returns the plunger 52 to its first position and, thereby, seals the aperture 50 in the separator wall 42.

In the preferred embodiment, the cleaning solution delivery system 32 is a mechanical system. However, the cleaning solution 33 may also be delivered by an electrically powered delivery system that sprays the cleaning solution onto the floor surface 34 (FIGS. 2 and 3). Further, any system, which adequately delivers the solution 33 to the floor surface 34, is within the scope of this invention.

Figure 7:
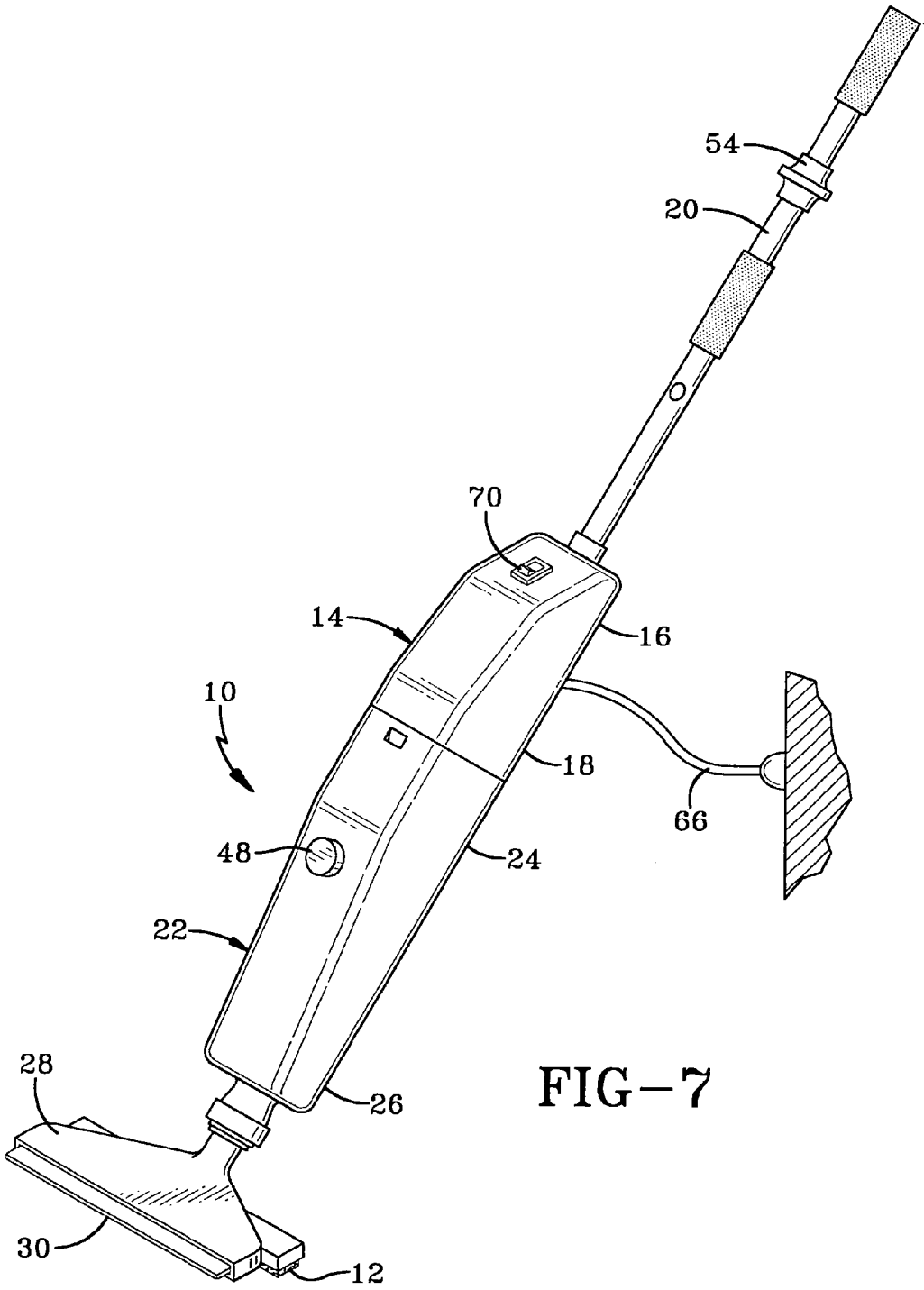

Turning now to FIG. 3, the motor housing 14, which contains the power system 58 that supplies a means for suctioning needed to remove the cleaning solution 33 from the floor surface 34, is best shown. The power system 58 includes a suction motor 60, an associated suction motor circuit 76, a power means 62, such as batteries 64 which also can be rechargeable, cells or a direct AC power source 66 (as shown in FIG. 7), a pump 68, a master switch 70 having first and second positions and a gravity switch 72, such as a mercury switch 74 (as shown in FIG. 2) or a weighted micro-switch 82. A plurality of wires (not referenced but shown) extend between the suction motor 60, the power means 62, the pump 68, the master switch 70 and the gravity switch 72 and provide the necessary electrical connections therebetween. Masters switch means 70 are well known in the art and therefore will not be disclosed in detail herein. It is sufficient to state that when the master switch 70 is in the first position, power is not supplied to the cleaning device 10.

With continuing reference to FIG. 3, the associated suction motor circuit 76 is controlled by the gravity switch 72. The gravity switch 72 selectively breaks the associated circuit 76 to turn off the suction motor 60. When the cleaning device 10 is in the scrubbing mode (as shown in FIG. 2), suction is not needed. Therefore, when the cleaning device 10 is rotated or flipped about its longitudinal axis 11 such that the stationary brush 12 faces the floor surface 34, the gravity switch 72 automatically breaks the associated circuit 76 to turn off the suction motor 60. Turning off the suction motor 60 when the device is in the scrubbing mode is desirable because it conserves power. This is especially important when utilizing the battery 64 for the cleaning device 10. If the suction motor 60 is left on during the scrubbing mode, the continuous power drain will quickly deplete the batteries 64 and the batteries 64 will be drained before the entire floor surface 34 is cleaned. On the other hand, when the cleaning device is in the suction mode, power is needed to turn on the suction motor 60, which provides the suction needed to remove the dirty cleaning solution from the floor surface. 34. In sum, when the cleaning device 10 is rotated or flipped about is longitudinal axis 11 such that the nozzle 28 faces the floor surface 34, the gravity switch 72 automatically closes the associated circuit 76 to turn on the suction motor 60.

In operation, a user activates the cleaning device 10 by moving the master switch 70 from a deactivated position to an activated position. Then, the user rotates the cleaning device 10 about its longitudinal axis 11 such that the stationary brush 12 faces the floor surface 34. Next, the user engages the means for releasing liquid 54 on the handle to dispense the unused cleaning solution onto the floor surface 34 and the user manually scrubs the floor surface 34 with the stationary brush 12. After the floor surface 34 is scrubbed, the user rotates the cleaning device 10 about its longitudinal axis 11, in the preferred embodiment 180° such that the nozzle 28 faces the floor surface 34. This causes the gravity switch 72 to close the associated suction motor circuit 76, which turns on the suction motor 60. The user can then suction the dirty cleaning solution upward through the nozzle 28 as shown by arrows C and D, along the direction of arrows E and F and into the second end 26 of the cleaning housing 22. A solution reflecting plate 80 can be located in the cleaning housing 22 to deflect the dirty cleaning solution downward in the direction of arrow G and into the recovery tank 84. The user can repeat this process as many times as is needed until the floor surface 34 is adequately cleaned. Once the floor surface 34 is clean or when the recovery tank 84 is full, the user can remove cleaning housing 22 from the motor housing 14 to empty and clean the recovery tank 84.

Turning to FIGS. 4–6, a cleaning device having a power driven brush 78 is illustrated by way of example. Except for the power driven brush system 92, this cleaning device 90 has the same overall configuration as the cleaning device 10 described in the first embodiment of this invention. Therefore, the description for the cleaning device 10 having the stationary brush 12 is included herein by reference and only the power driven brush system 92 will be described in detail.

With reference to FIG. 6, the power driven brush system 92 includes a power driven brush 78, a brush motor 86 and an associated brush motor circuit 88. A plurality of wires extend between the power driven brush 78, the brush motor 86, the power supply 62 and the gravity switch 72 and provide the necessary electrical connections therebetween. In the preferred embodiment, the wires removably connect the brush motor 86 to the gravity switch 72 and the power means 62 so that the cleaning housing 22 can be removed from the motor housing 14 to facilitate emptying and cleaning of the recovery tank 84. However, the recovery tank 84 may be provided with a cleaning solution removal means (not shown), such as an aperture in the recovery tank (not shown), to allow the tank 84 to be emptied without having to remove the cleaning housing 22 from the motor housing 14. Such a configuration would enable the brush motor 86 to be hard wired to the gravity switch 72 and the power means 62.

With specific reference to FIG. 6, the gravity switch 72 selectively transfers power from the suction motor 60 to the brush motor 86. When the cleaning device 90 is in the scrubbing mode, power must be supplied to the power driven brush 78 to facilitate scrubbing of the floor surface 34. Therefore, when the cleaning device 90 is rotated or flipped about its longitudinal axis 11 such that the power driven brush 78 faces the floor surface 34, the gravity switch 72 automatically breaks the associated suction motor circuit 76 to turn off the suction motor 60 and simultaneously closes the associated brush circuit 88 to turn on the brush motor 86. On the other hand, when the cleaning device is in the suction mode, power is needed to turn on the suction motor 60, which provides the suction needed to remove the dirty cleaning solution from the floor surface 34. Therefore, when the cleaning device 90 is rotated or flipped about is longitudinal axis 11 such that the nozzle 28 faces the floor surface 34, the gravity switch 72 automatically breaks the associated brush motor circuit 88 to turn off the brush motor 86 and simultaneously closes the associated suction motor circuit 76 to turn on the suction motor 60.

In operation, a user activates the cleaning device 90 by moving the master switch 70 from the first position to the second position. Then, the user rotates or flips the cleaning device 90 about its longitudinal axis 11 such that the power driven brush 78 faces the floor surface 34, which turns on the brush motor 86. Next, the user engages the means for releasing liquid 54 on the handle 20 to dispense the unused cleaning solution on the floor surface 34 and the user uses the power driven brush 78 to scrub the floor surface. After the floor surface is scrubbed, the user rotates or flips the cleaning device 90 about its longitudinal axis 11 such that the nozzle 28 faces the floor surface 34. This causes the gravity switch 72 to turn off the brush motor 86 and to simultaneously turn on the suction motor 60. The user can then use the nozzle 28 to suction the dirty cleaning solution off the floor surface 34 and into the recovery tank 84. The user can repeat this process as many times as is needed until the floor 34 surface is adequately cleaned. Once the floor surface 34 is clean, the user can remove cleaning housing 22 from the motor housing 14 to empty and clean the recovery tank 84.

In the preferred embodiment, separate motors drive the power driven brush 78 and the pump 68. However, a single motor (not shown) can power both the power driven brush 78 and the pump 68. In this configuration, the gravity switch 72 would selectively transfer power from the single motor to either the power driven brush 78 or the pump 68.

The invention has been described with reference to two preferred embodiments. Obviously, modifications and alterations will occur to others upon a reading and understanding of this specification. It is intended to include all such modifications and alternations in so far as they come within the scope of the appended claims or the equivalence thereof.

Having thus described the invention, it is now claimed:

The invention claimed is:

1. A floor care device having a first cleaning mode and a second cleaning mode, the floor care device comprising:

a base member for engaging a floor surface;

a handle connected to the base member, said handle being movable between a first cleaning position whereby the floor care device is placed in the first cleaning mode for manipulation about the floor surface and a second cleaning position whereby the floor care device is placed in the second cleaning mode for manipulation about the floor surface; and a switching member on one of the base member and handle whereby pivotal movement of the handle relative to the floor surface activates the switching member to change operation of the floor care device between the first and second cleaning modes.

2. The floor care device defined in claim 1 whereby the first cleaning mode includes at least a suction mode and the second mode includes at least a scrubbing mode.

3. The floor care device defined in claim 1 further including a solution tank for holding a cleaning solution on one of the handle and base, and a recovery tank for receiving used cleaning solution on one of the handle and base.

4. The floor care device defined in claim 3 further including a fluid distribution system operatively connected to the solution tank for delivering the cleaning solution from the solution tank to the floor surface.

5. The floor care device defined in claim 1 further including a squeegee attached to the base for assisting in the recovery of the used cleaning solution.

6. A floor care device, comprising:

a base member for engaging a floor surface, said base member having a first cleaning implement and a second cleaning implement;

a handle member connected to the base member;

a switching member positioned on one of the handle member or base member; and whereby pivotal movement of the handle relative to the floor surface activates the switching member to change operation of the floor care device between the first cleaning implement and the second cleaning implement.

7. The floor care device defined in claim 6 whereby the first implement includes at least a suction nozzle and the second implement includes at least a brush.

8. The floor care device defined in claim 7 whereby the first implement further includes a squeegee.

9. A floor care device, comprising:

a base member for engaging a floor surface, said base member having a first cleaning implement for operating the floor care device in a first mode of operation and second cleaning implement for operating the floor care device in a second mode of operation;

a housing member connected to the base member, a handle member connected to the housing member;

a solution tank mounted on the housing member for holding a cleaning solution;

a distribution system operatively connected to the solution tank for distributing the cleaning solution on the floor surface;

a motor-fan assembly for producing a suction in at least one of the first and second cleaning implements for recovering the cleaning solution from the floor surface;

a recovery tank operatively connected between the one of the first and second cleaning implements and the motor-fan assembly for receiving the cleaning solution from the floor surface;

a switching member mounted on one of the base member or housing member; and whereby rotation of the handle member about its longitudinal axis activates the switching member to change operation of the floor care device between the first mode of operation and the second mode of operation.

10. The floor care device defined in claim 9 whereby the first cleaning implement includes at least a suction nozzle and the second implement includes at least a brush.

11. The floor care device defined in claim 10 whereby the first implement further includes a squeegee.

12. A floor care device, comprising:

a base member for engaging a floor surface, said base member having a first cleaning implement for placing the floor care device in a first mode of operation and second cleaning implement for placing the floor care device in a second mode of operation;

a housing member connected to the base member;

a handle member connected to the housing member;

a solution tank mounted on the housing member for holding a cleaning solution;

a distribution system operatively connected to the solution tank for distributing the cleaning solution on the floor surface;

a motor-fan assembly for producing a suction at at least one of the first and second cleaning implements for recovering the cleaning solution from the floor surface;

a recovery tank operatively connected between the one of the first and second cleaning implements and the motor-fan assembly for receiving the cleaning solution from the floor surface;

a switch mounted on one of the base member and housing member; and whereby pivotal movement of the handle member relative to the floor surface activates the switch and switches the floor care device between the first and second mode of operation.

13. The floor care device defined in claim 12 whereby the first implement includes at least a suction nozzle and the second implement includes at least a brush.

14. The floor care device defined in claim 13 whereby the first implement further includes a squeegee.

* * * * *